US012167755B2

(12) United States Patent
Halliday et al.

(10) Patent No.: US 12,167,755 B2
(45) Date of Patent: Dec. 17, 2024

(54) AEROSOL PROVISION DEVICE

(71) Applicant: Nicoventures Trading Limited, London (GB)

(72) Inventors: Edward Joseph Halliday, London (GB); Ashley John Sayed, London (GB); Luke James Warren, London (GB)

(73) Assignee: NICOVENTURES TRADING LIMITED, London (GB)

( * ) Notice: Subject to any disclaimer, the term of this patent is extended or adjusted under 35 U.S.C. 154(b) by 564 days.

(21) Appl. No.: 17/593,143

(22) PCT Filed: Mar. 9, 2020

(86) PCT No.: PCT/EP2020/056239
§ 371 (c)(1),
(2) Date: Sep. 10, 2021

(87) PCT Pub. No.: WO2020/182748
PCT Pub. Date: Sep. 17, 2020

(65) Prior Publication Data

US 2022/0183394 A1 Jun. 16, 2022

(30) Foreign Application Priority Data

Mar. 11, 2019 (GB) ..... 1903245

(51) Int. Cl.
*A24F 40/60* (2020.01)
*A24F 40/51* (2020.01)
*A24F 40/53* (2020.01)

(52) U.S. Cl.
CPC ..... *A24F 40/60* (2020.01); *A24F 40/51* (2020.01); *A24F 40/53* (2020.01)

(58) Field of Classification Search
None
See application file for complete search history.

(56) References Cited

U.S. PATENT DOCUMENTS 9,357,803 B2 6/2016 Egoyants et al.
9,414,629 B2 8/2016 Egoyants et al.
(Continued)

FOREIGN PATENT DOCUMENTS

CN 107249364 A 10/2017
EP 3272382 A1 1/2018
(Continued)

OTHER PUBLICATIONS

"Examination Report No. 1 for Australian Patent Application No. 2020235041, mailed on Aug. 18, 2022", 3 pages.
(Continued)

*Primary Examiner* — Ross N Gushi
(74) *Attorney, Agent, or Firm* — Husch Blackwell

(57) ABSTRACT

An aerosol provision device is provided. The device comprises a heater assembly configured to heat aerosol generating material, an input interface configured to receive an input for selecting an operating mode from a plurality of operating modes and a controller. The controller is configured to detect operation of the input interface and cause the heater assembly to begin heating the aerosol generating material in dependence on the detected operation of the input interface.

20 Claims, 8 Drawing Sheets

(56) References Cited

U.S. PATENT DOCUMENTS

| | | | |
|---|---|---|---|
| 9,999,256 | B2 | 6/2018 | Abramov et al. |
| 10,051,893 | B2 | 8/2018 | Hoffman et al. |
| 11,528,941 | B2 | 12/2022 | Maeder et al. |
| 11,758,949 | B2 | 9/2023 | Bagai et al. |
| 11,849,757 | B2 | 12/2023 | Zouev |
| 11,856,654 | B2 | 12/2023 | Batista et al. |
| 2005/0268911 | A1 | 12/2005 | Cross et al. |
| 2013/0037041 | A1 | 2/2013 | Worm et al. |
| 2014/0360515 | A1 | 12/2014 | Vasiliev et al. |
| 2015/0272225 | A1 | 10/2015 | Worm et al. |
| 2016/0338412 | A1 | 11/2016 | Monsees et al. |
| 2017/0119053 | A1 | 5/2017 | Henry et al. |
| 2021/0052829 | A1* | 2/2021 | Dignum ..... A61M 11/042 |

FOREIGN PATENT DOCUMENTS

| | | | |
|---|---|---|---|
| JP | 2009502136 | A | 1/2009 |
| JP | 2014500017 | A | 1/2014 |
| JP | 2014524313 | A | 9/2014 |
| JP | 2014525237 | A | 9/2014 |
| JP | 2015532158 | A | 11/2015 |
| KR | 20170106454 | A | 9/2017 |
| KR | 20180070440 | A | 6/2018 |
| WO | 2013025921 | A1 | 2/2013 |
| WO | 2015046420 | A1 | 4/2015 |
| WO | 2016090426 | A1 | 6/2016 |
| WO | 2016135959 | A1 | 9/2016 |
| WO | 2016175320 | A1 | 11/2016 |
| WO | 2016188967 | A1 | 12/2016 |
| WO | 2017205692 | A1 | 11/2017 |
| WO | 2017207674 | A1 | 12/2017 |
| WO | 2018087719 | A1 | 5/2018 |
| WO | 2018146453 | A1 | 8/2018 |
| WO | 2018202651 | A1 | 11/2018 |
| WO | 2018206616 | A1 | 11/2018 |
| WO | 2018206940 | A1 | 11/2018 |
| WO | 2019030366 | A1 | 2/2019 |
| WO | 2019031877 | A2 | 2/2019 |
| WO | 2019200194 | A1 | 10/2019 |

OTHER PUBLICATIONS

"Examination Report received for New Zealand Application No. 779472, mailed on Dec. 18, 2023", 2 pages.

"Examination Report received for New Zealand Application No. 779472, mailed on Jul. 5, 2023", 3 pages.

"International Preliminary Report on Patentability for Application No. PCT/EP2020/056241, mailed on Sep. 23, 2021", 9 pages.

"International Preliminary Report on Patentability received for PCT Patent Application No. PCT/EP2020/056239, mailed on Sep. 23, 2021", 7 Pages.

"International Search Report and Written Opinion for International Application No. PCT/EP2020/056241 mailed on Jun. 24, 2020", 13 pages.

"International Search Report and Written Opinion received for PCT Patent Application No. PCT/EP2020/056239, mailed on May 20, 2020", 9 Pages.

"Office Action received for Chinese Patent Application No. 202080034768.4, mailed on Jun. 26, 2023", 9 pages (Official Copy Only).

"Office Action received for Korean Patent Application No. 10-2021-7029236, mailed on Oct. 6, 2023", 9 pages (4 pages of English Translation and 5 pages of Official Copy).

"Office Action received for Russian Patent Application No. 2021126500, mailed on Jun. 2, 2022", 20 pages (12 pages of English Translation and 8 pages of Official Copy).

"Reason for Refusal received for Japanese Patent Application No. 2021-554596, mailed on Jan. 4, 2023", 10 pages (5 pages of English Translation and 5 pages of Official Copy).

"Response to Examination Report received for New Zealand Application No. 779472, mailed on Dec. 12, 2023", 107 pages.

* cited by examiner

AEROSOL PROVISION DEVICE

PRIORITY CLAIM

The present application is a National Phase entry of PCT Application No. PCT/EP2020/056239, filed Mar. 9, 2020, which claims priority from Great Britain Application No. 1903245.7, filed Mar. 11, 2019, each of which is hereby fully incorporated by reference herein.

TECHNICAL FIELD

The present invention relates to aerosol provision devices and methods of operating aerosol provision devices.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

SUMMARY

According to a first aspect of the present disclosure, there is provided an aerosol provision device, comprising:

a heater assembly configured to heat aerosol generating material;

an input interface configured to receive an input for selecting an operating mode from a plurality of operating modes; and a controller, configured to:

detect operation of the input interface; and cause the heater assembly to begin heating the aerosol generating material in dependence on the detected operation of the input interface.

According to a second aspect of the present disclosure, there is provided a method of operating an aerosol provision device, comprising:

detecting operation of an input interface, wherein the input interface is configured to receive an input for selecting an operating mode from a plurality of operating modes; and causing a heater assembly to begin heating aerosol generating material in dependence on the detected operation of the input interface.

Further features and advantages of the invention will become apparent from the following description of preferred embodiments of the invention, given by way of example only, which is made with reference to the accompanying drawings.

DETAILED DESCRIPTION

Figure 1:
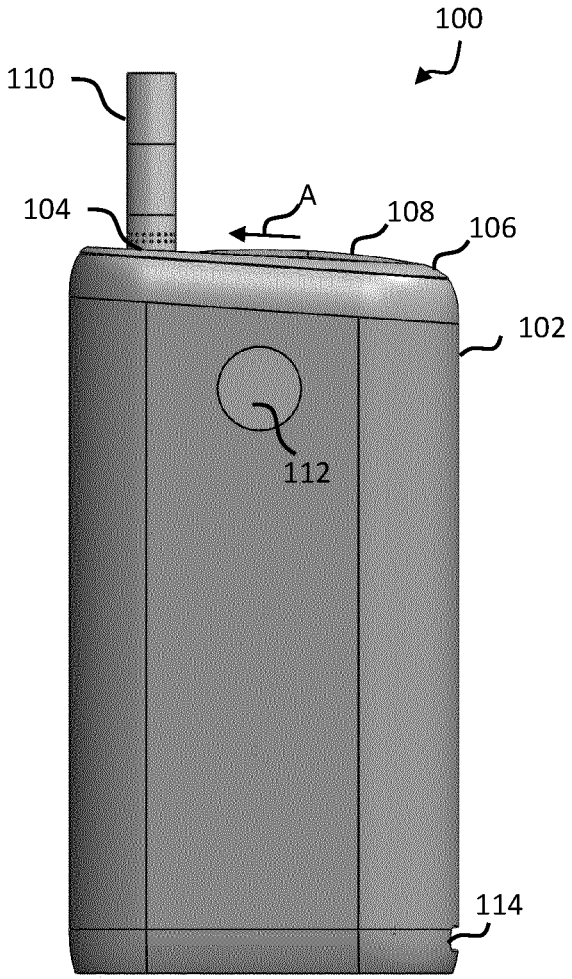
FIG. 1 shows a front view of an example of an aerosol provision device.

As used herein, the term "aerosol generating material" includes materials that provide volatilized components upon heating, typically in the form of an aerosol. Aerosol generating material includes any tobacco-containing material and may, for example, include one or more of tobacco, tobacco derivatives, expanded tobacco, reconstituted tobacco or tobacco substitutes. Aerosol generating material also may include other, non-tobacco, products, which, depending on the product, may or may not contain nicotine. Aerosol generating material may for example be in the form of a solid, a liquid, a gel, a wax or the like. Aerosol generating material may for example also be a combination or a blend of materials. Aerosol generating material may also be known as "smokable material".

Apparatuses are known that heat aerosol generating material to volatilize at least one component of the aerosol generating material, typically to form an aerosol which can be inhaled, without burning or combusting the aerosol generating material. Such an apparatus is sometimes described as an "aerosol generating device," an "aerosol provision device," a "heat-not-burn device," a "tobacco heating product device," or a "tobacco heating device" or similar. Similarly, there are also so-called e-cigarette devices, which typically vaporize an aerosol generating material in the form of a liquid, which may or may not contain nicotine. The aerosol generating material may be in the form of or be provided as part of a rod, cartridge or cassette or the like which can be inserted into the apparatus. A heater for heating and volatilizing the aerosol generating material may be provided as a "permanent" part of the apparatus.

An aerosol provision device can receive an article comprising aerosol generating material for heating. An "article" in this context is a component that includes or contains in use the aerosol generating material, which is heated to volatilize the aerosol generating material, and optionally other components in use. A user may insert the article into the aerosol provision device before it is heated to produce an aerosol, which the user subsequently inhales. The article may be, for example, of a predetermined or specific size that is configured to be placed within a heating chamber of the device which is sized to receive the article.

A first aspect of the present disclosure defines an aerosol provision device comprising an input interface configured to receive an input for selecting an operating mode from a plurality of operating modes. Thus, a user can interact with, or operate the input interface to operate the device. The device further comprises a controller that detects operation of the input interface and causes a heater assembly to begin heating aerosol generating material in dependence on the detected operation of the input interface.

The device therefore begins heating the aerosol generating material only after the controller detects operation of the input interface.

In a first example, the controller is configured to: (i) determine a selected operating mode based on the operation of the input interface, and (ii) responsive to determining the selected operating mode, cause the heater assembly to begin heating the aerosol generating material according to the selected operating mode. Thus, the device may only begin heating the aerosol generating material after the controller has determined which of the plurality of operating modes has been selected. This can be useful in cases when the operating modes include modes in which the heating is not required or when the user accidentally operates the input interface, but does not select an operating mode. By heating the aerosol generating material only after an operating mode has been selected, the device can be more energy efficient. The plurality of operating modes may comprise a heating mode and a settings mode, for example. A settings mode can allow the user to configure settings of the device. Thus, in some examples, the controller causes the heater assembly to begin heating the aerosol generating material when the selected operating mode is a heating mode.

As mentioned, the plurality of operating modes may comprise a heating mode and a settings mode. When it is determined that the operation of the input interface is indicative of a selection of the heating mode, the controller is configured to (i) determine a selected heating mode based on the operation and (ii) cause the heater assembly to begin heating the aerosol generating material according to the selected heating mode. When it is determined that the operation of the input interface is indicative of a selection of the settings mode, the controller is configured to (i) operate the device in the settings mode without causing the heater assembly to begin heating the aerosol generating material. In some examples the controller determines a selected settings mode based on the operation. Accordingly, the device only begins heating when the selected operating mode is a heating mode. This can save energy. In the settings mode, the user may configure settings of the device. For example, they may choose settings associated with one or more heating modes. The user may also configure settings of a haptic component. For example, they may choose particular parameters associated with the haptic feedback provided by the haptic component. The settings mode may also allow a user to check the charge status of the device's battery, for example.

Preferably, the controller causes the heater assembly to begin heating the aerosol generating material according to the selected heating mode at substantially the same time as determining the selected heating mode. For example, they may occur simultaneously. This reduces the time the user needs to wait until they begin using the device. In other examples there may be a small delay between these steps, such as less than 1 second, less than 0.5 seconds, less than 0.1 seconds, less than 0.01 seconds, or less than 0.001 seconds.

In the above examples, the device is operated (in either a heating mode, or settings mode) only after the controller has determined a selected operating mode. In a second example, the device may be operated in a heating mode even before the controller has determined a selected operating mode. For example, the controller may cause the heating assembly to begin heating before an operating mode (either heating mode or settings mode) is selected. This can be useful to decrease the time between initially operating the input interface and using the device. For example, it may be assumed that a user is more likely to operate the input interface to operate the device in a heating mode rather than a settings mode so heating begins as soon as a user operates the input interface, even if they go on to select a settings mode, rather than a heating mode.

Accordingly, in this second example, the plurality of operating modes may comprise a heating mode and a settings mode and the controller is configured to detect selection of an operating mode based on the operation of the input interface and cause the heater assembly to begin heating the aerosol generating material before detecting selection of the operating mode. Accordingly, the controller begins heating before the user has selected an operating mode and after detecting (initial) operation of the input interface. The heating therefore begins regardless of whether the user goes on to select a heating mode or a settings mode.

In some examples, the plurality of operating modes comprises only heating modes.

Regardless of whether the plurality of operating modes comprises only heating modes or both heating modes and settings modes, the heater assembly can begin heating the aerosol generating material before detecting selection of an operating mode. After detecting selection of a heating mode, the controller may cause the heater assembly to begin heating the aerosol generating material according to the selected heating mode. Before selection of the heating mode, the controller may cause the heater assembly to begin heating the aerosol generating material according to a first rate, and after detecting selection of the heating mode, the controller may cause the heater assembly to begin heating the aerosol generating material according to a second rate, different to the first rate. The second rate may be dependent upon the selected heating mode, whereas the first rate may be a predetermined or "default" rate.

In a particular example, the selected operating mode is a settings mode, and the controller is configured to cause the heater assembly to stop heating the aerosol generating material after detecting that the selected operating mode is the settings mode. Accordingly, if a user goes on to select the settings mode, the device stops heating. In this period of time, the device may have used a small amount of energy. However, this may be an acceptable compromise to reduce the time taken to heat the aerosol generating material to full temperature when the user selects a heating mode. As mentioned, it may be assumed that the user selects a heating mode most of the time.

The input interface may also be referred to as a user interface. The input interface may be a button, touch screen, dial, knob, or a wireless connection to a mobile device (e.g. Bluetooth). The interface allows the user to select an operating mode from a plurality of operating modes. When the input interface is operated, the input interface can send one or more signals to the controller indicative of the operation. Based on the signal(s), the controller can determine a selected operating mode, such as a selected heating or settings mode.

The input interface may be a sensor to detect the insertion of aerosol generating material. The sensor may determine the type of article that is inserted, and an operating mode is determined based on the detected type of article.

In any of the above examples, the input interface may comprise a single button for receiving an input to select an operating mode from the plurality of operating modes. Thus, using a single button the user can select different modes. Having a single interface to select multiple modes can simplify operation of the device and reduce the number of components. A reduced number of components can make the device more lightweight and there are fewer parts to break or malfunction, increasing reliability. The button may be a software button or a hardware button.

In one example, the input comprises an indication that the button has been released and an indication of a length of time the button was pressed before it was released. The controller is configured to, responsive to the input comprising the indication that the button has been released, determine a selected operating mode based on the length of the time the button was pressed before it was released. Accordingly, an operating mode may be selected based on the length of time the button is selected. This can simplify operation of the device. In some examples, this also allows the device to save energy because instantaneous, accidental button presses may not cause an operating mode to be selected. For example, the controller may be configured to determine a selected operating mode when the length of time the button was pressed is greater than or equal to a threshold, and the controller does not determine a selected operating mode when the length of time is less than the threshold. The threshold can act as a buffer to avoid operating the device in any operating mode when the button is accidentally pressed.

The controller can receive the input from the input interface. The input indicating the release and length of time may be sent between the input interface and controller as one or more signals. In one example, a signal may indicate the length of time, or a signal may indicate a button press so the length of time the button is held can be timed by the controller between the button press and the button release signals.

A heating mode may be determined as the selected mode when the length of time the button has been pressed is within a first time range and a settings mode is determined as the selected mode when the length of time the button has been pressed is a within a second time range, wherein the second time range has a start time after an end time of the first time range. This can be advantageous because it is quicker to select the heating mode. In general, a user is more likely to use a heating mode more often, so this saves time.

In a particular example, the start time of the first time range may be 5 seconds after the point at which button is initially pressed. The start time of the second time range may be 8 seconds after the point at which button is initially pressed, for example. In one example, the end time of the first time range corresponds to the start time of the second time range. For example, if the button is held down for greater than 5 seconds and less than 8 seconds, the heating mode is selected. In another example, the end time of the first time range occurs before the start time of the second time range. For example, the end time of the first time range may occur 7 seconds after the point at which the button is initially pressed (i.e. 1 second before the start time of the second time range). Accordingly, if the button is held down for greater than 5 seconds and less than 7 seconds, the heating mode is selected. If the button is held down for 7.5 seconds, then no mode is selected. Preferably the end time of the first time range corresponds to the start time of the second time range to reduce the time for selecting the different operating modes.

In one example, the device is configured to operate in a first heating mode if the length of time that the button has been pressed is greater than or equal to a first threshold time period and is less than a second threshold time period, and the device is configured to operate in a second heating mode if the length of time that the button has been pressed is greater than or equal to the second threshold time period. The first threshold time period may be 3 seconds, and the second threshold time period may be 5 seconds, for example. The device may be configured to operate in a settings mode if the length of time that the button has been pressed is greater than or equal to a third threshold time period. The second heating mode may be selected if the length of time that the button has been pressed is greater than or equal to the second threshold time period and is less than the third threshold time period. The third threshold time period may be 8 seconds, for example.

In some examples, the device comprises an indicator assembly and the controller is configured to cause the indicator assembly to provide an indication based on the length of time the button was pressed. The indication may be provided when an operating mode is selected. Accordingly, the user may be notified/informed that they have held down the button for a particular length of time.

In some examples, the device can operate in two or more different heating modes. For example, each heating mode may heat the aerosol generating material to a different temperature, and/or may heat the aerosol generating material for a different length of time.

The controller may be configured to cause the heater assembly to heat at a first rate while the button has been pressed for an initial period of time without being released, and to cause the heater assembly to heat at a second rate while the button continues to be pressed after the initial period of time, wherein the first rate is slower than the second rate. This can guard against accidental button presses to save power. Also, in one example, if the button is pressed for a length of time less than the initial period of time, a settings mode is selected, and if the button is pressed for a length of time after the initial period of time, a heating mode is selected. Thus, during the initial period of time, the user may still be trying to select a settings mode to check the charge status of the battery, for example. By heating at a slower rate before this initial period of time, energy can be saved because there is a possibility that the user may select the settings mode. The "initial period of time" may be known as a threshold period of time.

In the example where the heater begins heating before an operating mode is selected, the controller may be configured to cause the heater assembly to begin heating the aerosol generating material: (i) before detecting selection of the operating mode, and (ii) after a predetermined period of time has elapsed since detecting an initial operation of the input interface. Accordingly, the device may have a built in time delay to avoid accidental button presses to save power. The period of time may be 0.5 seconds after detecting the initial operation, for example, In some examples, to ensure that the user is aware the device is ready for use, the aerosol provision device comprises an indicator assembly to indicate that the device is ready for the user to inhale the aerosol. This can avoid having the user wait for longer than necessary to inhale the aerosol, which can waste aerosol and reduce user satisfaction.

"Ready for use" may mean that the aerosol generating material has reached a desired/sufficient temperature, may mean that the aerosol generating material has generated a desired/sufficient volume of aerosol, or may mean that the user can take a first "puff" on the device, to inhale aerosol generated by the aerosol generating material.

The heater assembly may be an inductive heater assembly. For example, the heater assembly may comprise one or more inductor coils and a susceptor. The heater assembly may comprise one or more coils to heat a heater component. In another example, the heater assembly may be a resistive heater assembly. For example, one or more components may be heated resistively which heat the aerosol generating material.

The controller may be configured to cause the indicator assembly to indicate that the device is ready for use within (or at) a predetermined period of time after causing the heater assembly to begin heating the aerosol generating material. In some examples, the predetermined period of time is less than about 30 seconds, or less than about 20 seconds, or less than about 15 seconds, or less than about 10 seconds after causing the heater assembly to begin heating. In other examples, the predetermined period of time is less than about 60 seconds, or less than about 50 seconds, or less than about 40 seconds.

It has been found that certain heating assemblies, such as inductive heating assemblies, are able to heat aerosol generating material to a suitable temperature within a reduced period of time when compared to other types of heating assemblies. Accordingly, a user of the device may be able to draw on the device to inhale the aerosol in a predetermined period of less than about 20 seconds, for example. Because certain heating assemblies are able to heat the aerosol generating material quickly, the aerosol generating material will have released a sufficient amount of aerosol at the time the device indicates that the device is ready.

As mentioned, the device may be configured to operate in one of a first heating mode and a second heating mode and when the device is operated in the first heating mode a component of the heater assembly is to be heated to a first temperature, and when the device is operated in the second heating mode a component of the heater assembly is to be heated to a second temperature. The second temperature may be higher than the first temperature.

The first temperature may be between about 240° C. and about 260° C. and the second temperature may be between about 270° C. and about 290° C. The temperature of the aerosol generating material may be marginally less than the temperature of the heater component.

The first heating mode may be known as a default mode, and the second heating mode may be known as a boost mode. The second heating mode may, for example, generate a higher volume or concentration of aerosol than the first heating mode.

In some examples the indicator assembly provides an indication that the heater assembly has begun to heat the aerosol generating material. This can avoid the user trying to start operation of the device again.

In one arrangement, the indicator assembly comprises a visual component configured to provide a visual indication. For example, the visual component may comprise an LED, a plurality of LEDs, a display, an eInk display, or a mechanical element which moves to display one or more patterns, for example. In some examples, the visual component is configured to emit light.

In another arrangement, the indicator assembly comprises a haptic component configured to provide haptic feedback. For example, the haptic component may be a haptic motor which causes the device to vibrate.

In another arrangement, the indicator assembly comprises an audible indicator configured to emit sound. The audible indicator may be a transducer, buzzer, beeper, etc.

In a particular example, the indicator assembly comprises a haptic component and a visual component. The haptic component may be configured to provide a haptic indication that the heater assembly has begun heating the aerosol generating material. The visual component may be configured to provide a visual indication that the device is ready for use.

In a particular example, the heater assembly comprises an inductor coil for generating a varying magnetic field and a susceptor arranged to heat the aerosol generating material, wherein the susceptor is heatable by penetration with the varying magnetic field. The controller is configured to cause the heater assembly to begin heating the aerosol generating material according to the selected heating mode by causing the inductor coil to generate the varying magnetic field. Accordingly, the susceptor may be the component of the heater assembly which is heated. For example, in the first heating mode, the inductor coil may be configured to heat the susceptor to a first temperature. In the second heating mode, for example, the inductor coil may be configured to heat the susceptor to a second temperature.

It has been found that inductive heating systems are able to heat aerosol generating material to a suitable temperature within a reduced period of time when compared to other types of heating assemblies, such as resistive heating assemblies.

In another aspect, there is provided a method of operating the aerosol provision device described above. The method comprises detecting operation of an input interface, wherein the input interface is configured to receive an input for selecting an operating mode from a plurality of operating modes, and causing a heater assembly to begin heating aerosol generating material in dependence on the detected operation of the input interface.

The method may further comprise detecting selection of an operating mode based on the operation of the input interface and responsive to detecting the selection of the operating mode, causing the heater assembly to begin heating the aerosol generating material according to the selected operating mode.

The plurality of operating modes may comprise a heating mode and a settings mode, and the method may further comprise:

- when it is determined that the operation of the input interface is indicative of a selection of the heating mode, causing the heater assembly to begin heating the aerosol generating material according to the selected heating mode; and
- when it is determined that the operation of the input interface is indicative of a selection of the settings mode, operating the device in the settings mode without causing the heater assembly to begin heating the aerosol generating material.

The input interface may comprise a single button for receiving an input to select an operating mode from the plurality of operating modes, and the method may further comprise:

- detecting that the button has been released;
- detecting a length of time the button was pressed before it was released; and
- determining a selected operating mode based on the length of the time the button was pressed before it was released.

The method may further comprise comprising causing an indicator assembly of the device to provide an indication based on the length of time the button was pressed.

The plurality of operating modes may comprise a heating mode and a settings mode, and the method may further comprise:

- detecting selection of an operating mode based on the operation of the input interface; and
- causing the heater assembly to begin heating the aerosol generating material before detecting selection of the operating mode.

The selected operating mode may be a settings mode, and the method may further comprise causing the heater assembly to stop heating the aerosol generating material after detecting that the selected operating mode is the settings mode.

The method may further comprise causing the heater assembly to begin heating the aerosol generating material:

before detecting selection of the operating mode; and after a predetermined period of time has elapsed since detecting an initial operation of the input interface.

Although this method is described in relation to any type of heater assembly, it will be appreciated that this method may also be applied to a device with an inductive heater assembly.

Preferably, the device is a tobacco heating device, also known as a heat-not-burn device.

FIG. 1 shows an example of an aerosol provision device 100 for generating aerosol from an aerosol generating medium/material. In broad outline, the device 100 may be used to heat a replaceable article 110 comprising the aerosol generating medium, to generate an aerosol or other inhalable medium which is inhaled by a user of the device 100.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 1, the lid 108 is shown in an open configuration, however the cap 108 may move into a closed configuration. For example, a user may cause the lid 108 to slide in the direction of arrow "A".

The device 100 may also include an input interface 112, which may comprise a button or switch, which operates the device 100 when pressed. For example, a user may turn on the device 100 by operating the input interface 112.

The device 100 may also comprise an electrical connector/component, such as a socket/port 114, which can receive a cable to charge a battery of the device 100. For example, the socket 114 may be a charging port, such as a USB charging port. In some examples the socket 114 may be used additionally or alternatively to transfer data between the device 100 and another device, such as a computing device.

Figure 2:
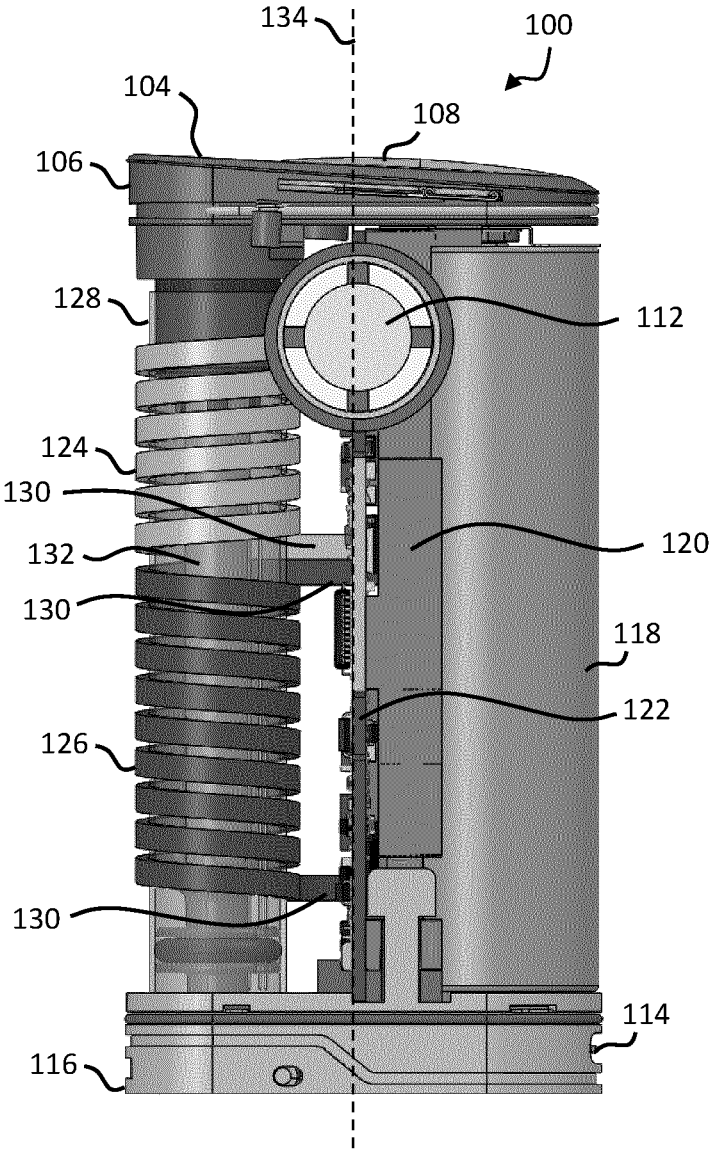
FIG. 2 shows a front view of the aerosol provision device of FIG. 1 with an outer cover removed.

FIG. 2 depicts the device 100 of FIG. 1 with the outer cover 102 removed and without an article 110 present. The device 100 defines a longitudinal axis 134.

As shown in FIG. 2, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place. The central support 120 may also be known as a battery support, or battery carrier.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper litz wire which has a rectangular cross section. In other examples the litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 2, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section of the article 110, and at a later time, the second inductor coil 126 may be operating to heat a second section of the article 110. Winding the coils in opposite directions helps reduce the current induced in the inactive coil when used in conjunction with a particular type of control circuit. In FIG. 2, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The device 100 of FIG. 2 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

The insulating member 128 can also fully or partially support the first and second inductor coils 124, 126. For example, as shown in FIG. 2, the first and second inductor coils 124, 126 are positioned around the insulating member 128 and are in contact with a radially outward surface of the insulating member 128. In some examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

Figure 3:
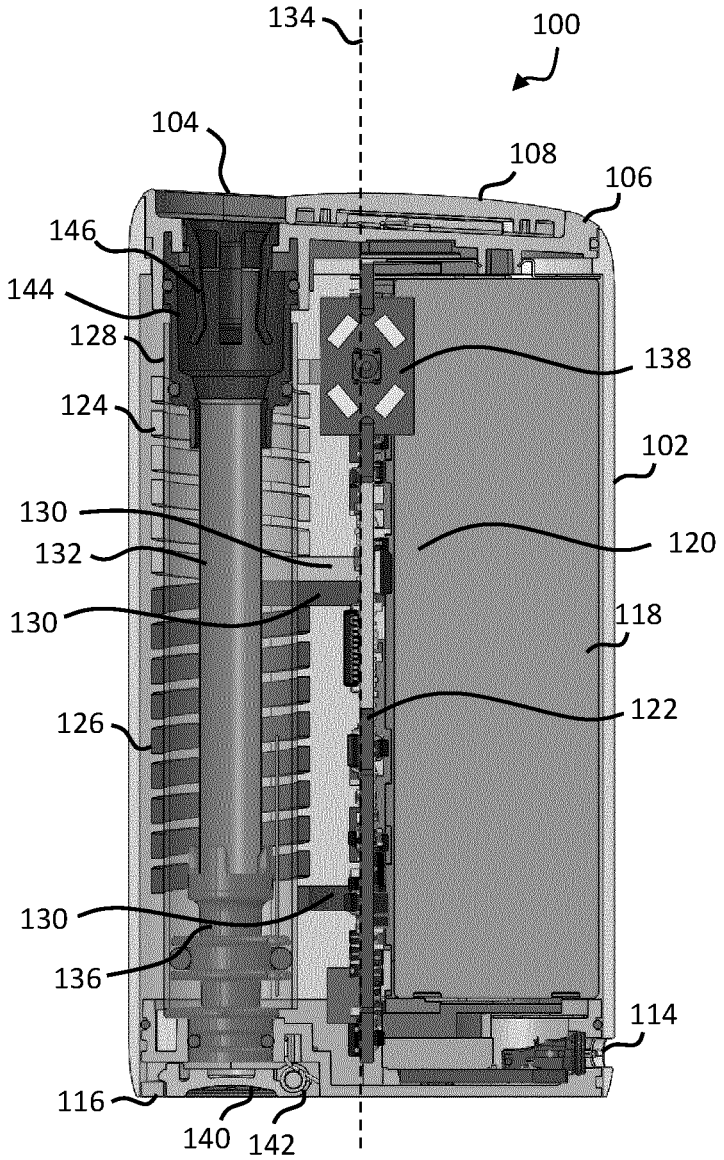
FIG. 3 shows a cross-sectional view of the aerosol provision device of FIG. 1.

FIG. 3 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the input interface 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 4:
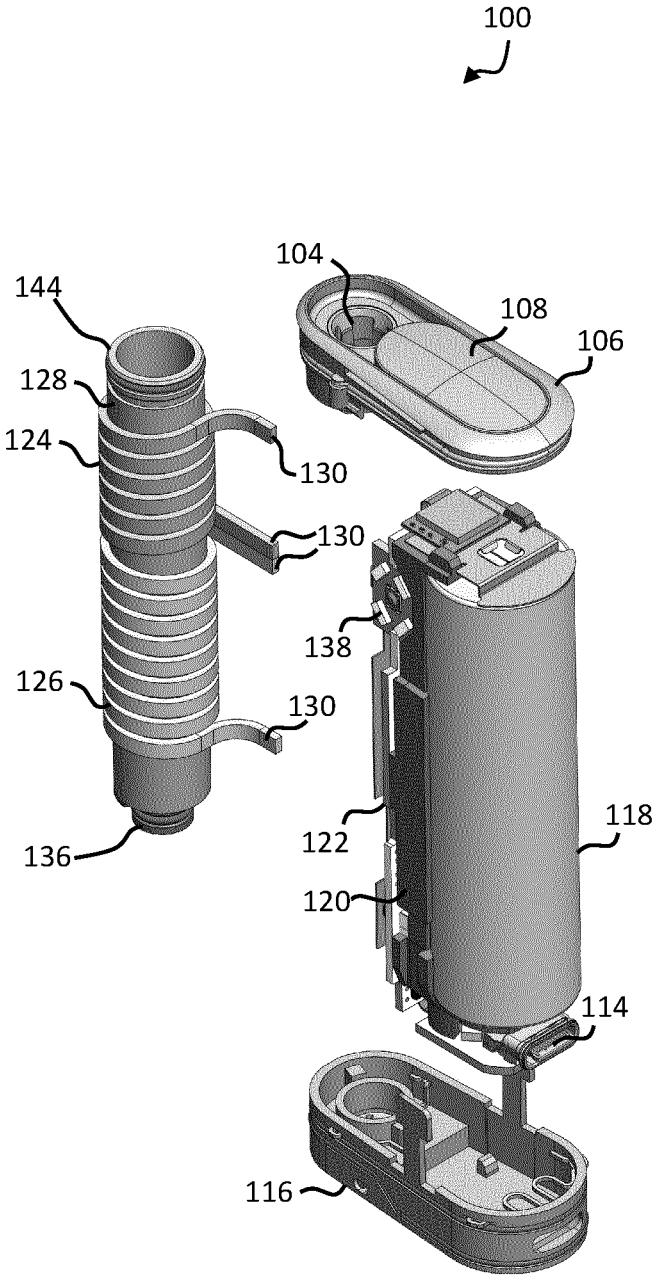
FIG. 4 shows an exploded view of the aerosol provision device of FIG. 2.

FIG. 4 is an exploded view of the device 100 of FIG. 1, with the outer cover 102 omitted.

Figure 5A:
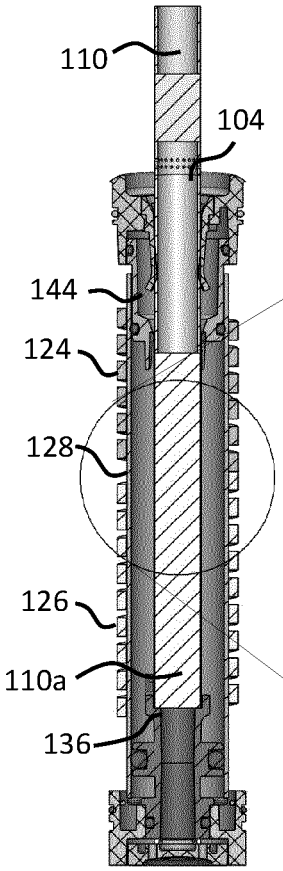
FIG. 5A shows a cross-sectional view of a heating assembly within an aerosol provision device.
Figure 5B:
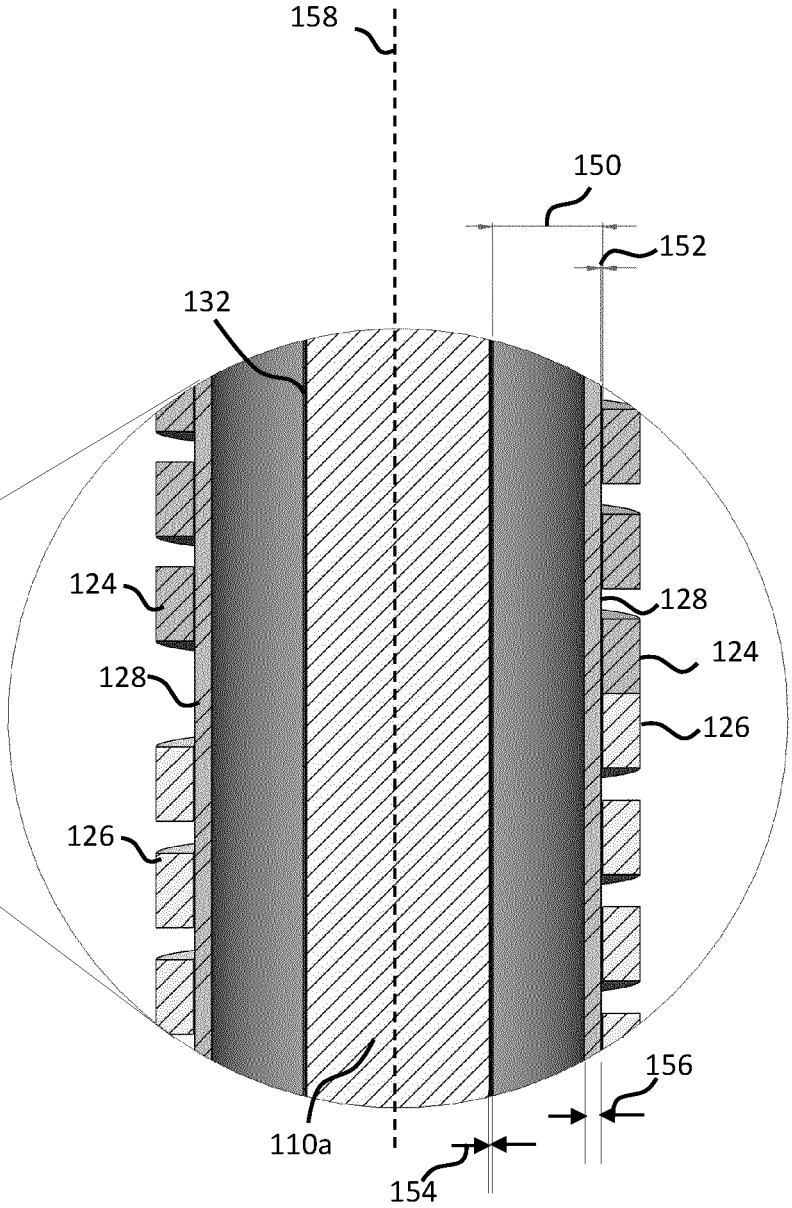
FIG. 5B shows a close-up view of a portion of the heating assembly of FIG. 5A.

FIG. 5A depicts a cross section of a portion of the device 100 of FIG. 1. FIG. 5B depicts a close-up of a region of FIG. 5A. FIGS. 5A and 5B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 5B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3 mm to 3.5 mm, or about 3.25 mm.

FIG. 5B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, about 0.25 mm to 1 mm, or about 0.5 mm.

Figure 6:
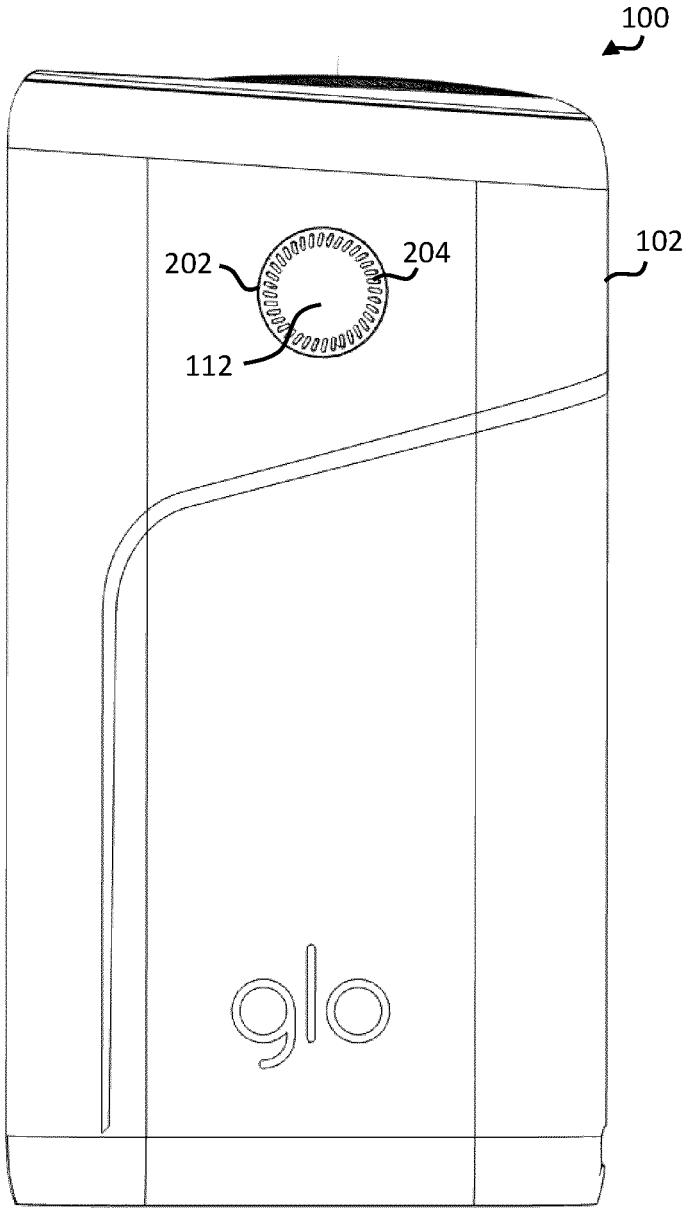
FIG. 6 shows a front view of the device.

FIG. 6 depicts a front view of the device 100. As briefly mentioned above, the device may comprise an input interface 112. In some examples the user may interact with the input interface 112 to operate the device 100. Arranged in proximity to the input interface 112 may be an indicator assembly, which can indicate the occurrence of one or more events to a user, such as when the device is ready for use and/or when the device has finished operating. The indicator assembly may also indicate a mode in which the device 100 is operating.

FIG. 6 depicts an outer member 202 positioned above (i.e. in front of) an indicator assembly. In other examples, the indicator assembly may be positioned elsewhere on the device. In the present example, the indicator assembly comprises a visual component configured to provide a visual indication. The visual component comprises a plurality of LEDs which emit electromagnetic radiation, such as light, to indicate certain events to a user. It will be appreciated that indicator assembly may additionally or alternatively comprise a haptic component or an audible indicator. In the present device 100, the indicator assembly comprises a visual component and a haptic component.

The outer member 202 forms the outermost component of the input interface 112. A user may press the outer member 202 to interact with the device 100. The outer member 202 comprises a plurality of apertures 204 through which light from a plurality of LEDs can pass. In the present example, the device 100 comprises four LEDs which sequentially light up as the heater assembly heats the aerosol generating material. When all four LEDs are lit, the user can be informed that the device is ready for use. The first of the four LEDs may light up after a user has selected an operating mode, or may light up when a user first operates the input interface 112.

Figure 7:
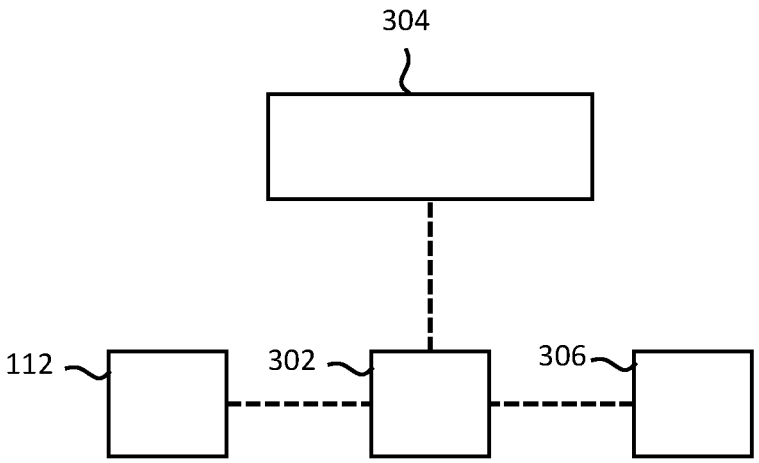
FIG. 7 shows a system comprising a controller, a heater assembly, an input interface and an indicator assembly.

FIG. 7 depicts a system comprising a controller 302 (such as one or more processors), a heater assembly 304, an indicator assembly 306 and the input interface 112. The controller 302 is communicatively coupled to the heater assembly 304, the indicator assembly 306 and the input interface 112 via one or more wired or wireless connections (shown as dashed lines). The indicator assembly 306 may be omitted in certain examples.

The controller 302 may be located on the PCB 122, for example. The controller 302 can control operations of the device 100, such as causing the heater assembly 304 to heat aerosol generating material. In some examples, the controller 302 detects operation of the input interface 112, and responsively controls the heater assembly 304 and indicator assembly 306. A user can provide an input to the input interface 112 to operate the device. A heating mode or settings mode can be selected via the input interface 112.

The indicator assembly 306 can indicate the occurrence of one or more events to a user. To cause the indicator assembly 306 to provide an indication, the controller 302 can send a signal or instruction to the indicator assembly 306. In the example of FIG. 6, the indicator assembly 306 comprises a visual component comprising a plurality of LEDs. Other types of indicator assembly 306 may be additionally or alternatively used.

In the present example, the heater assembly 304 comprises one or more inductor coils which generate one or more magnetic fields to heat a susceptor. The controller 302 can cause the inductor coil(s) of the device 100 to generate a varying magnetic field. For example, the controller 302 can send one or more signals to the inductor coil(s). Once the inductor coil(s) have begun generating the varying magnetic field, the susceptor 132 is heated, which in turn heats any aerosol generating material located near to the susceptor 132. It will be appreciated that the following description may also apply to other types of heater assembly 304.

The controller 302 may cause one or more inductor coils to heat the susceptor to between about 240° C. and about 290° C. In a specific example, the device is configured to operate in one of a first heating mode and a second heating mode, where the first and second heating modes are heating modes. In one example, when the device is operating in a first (default) heating mode, the controller 302 may cause the first inductor coil 124 to heat a first region of the susceptor 132 to between about 240° C. and about 260° C., such as about 250° C. In another example, the device may be operating in a second (boost) heating mode, and the controller 302 may cause the first inductor coil 124 to heat a first region of the susceptor 132 to between about 270° C. and about 290° C., such as about 280° C.

The second inductor coil 126 may generate a second magnetic field at a later time during the heating session. For example, the second inductor coil 126 may generate the second magnetic field between about 60 seconds and about 130 seconds after the first inductor coil 124 generates a first magnetic field. The second inductor coil is arranged to heat a second region of the susceptor 132. In some examples, both inductor coils 124, 126 operate at the same time.

After the first inductor coil 124 begins heating the susceptor 132, the first region of the susceptor 132 may reach the desired temperature within 2 seconds. However, it may take longer for the heat to penetrate into the aerosol generating material. For example, it may take up to 60 seconds for the aerosol generating material to approach the temperature of the susceptor 132. Due to the efficient nature of inductive heating, the aerosol produced within the first 10-30 seconds may still be suitable for inhalation, despite the aerosol generating material not being fully heated.

Input Interface

As mentioned above, the controller 302 detects operation of the input interface 112, and responsively causes the heater assembly 304 to begin heating the aerosol generating material in dependence on the detected operation of the input interface 112. By operating the input interface 112, an operating mode of the device can be selected. In some examples, the operating modes include one or more heating modes and one or more settings modes.

In the present example, the input interface 112 comprises a single button and the input interface 112 sends one or more signals or data to the controller 302 to indicate that the user has operated the input interface 112. In a specific example, the one or more signals indicate that the user has released the button and a length of time the button was pressed before it was released. A user can therefore press and hold the button, and the controller 302 determines the selected operating mode based on length of time the button was pressed.

Accordingly, the device can be operated in a particular mode depending upon the length of time. The selected operating mode can be determined by the controller 302 by comparing the length of time the button was pressed to one or more threshold time periods.

The device 100 may be configured to operate in a first heating mode or a second heating mode. Thus, in a particular example, if the length of time that the button has been pressed is greater than or equal to a first threshold time period and is less than a second threshold time period, the controller 302 is configured to operate the device in the first heating mode. If the length of time that the button has been pressed is greater than or equal to the second threshold time period, the device is configured to operate in the second heating mode. The first threshold time period may be 3 seconds, and the second threshold time period may be 5 seconds, for example. Thus, using a single button the user can select different modes. If the user holds down the button for longer than 3 seconds, but less than 5 seconds, the device operates in the first heating mode.

In a particular example, if the length of time that the button has been pressed is greater than or equal to a third threshold time period, the device is configured to operate in a settings mode. A settings mode can allow the user to configure settings of the device. The third threshold time period may be greater than the second threshold time period. In a particular example, the third threshold time period is 8 seconds. If the user holds down the button for longer than 5 seconds, but less than 8 seconds, the device operates in the second heating mode.

Accordingly, in one example a heating mode may be determined as the selected mode when the length of time the button has been pressed is within a first time range and a settings mode is determined as the selected mode when the length of time the button has been pressed is a within a second time range. The first time range may have a start time of 5 seconds after the button has been pressed and an end time at 8 seconds after the button has been pressed. The second time range may have a start time of 8 seconds after the button has been pressed. This can be advantageous because it is quicker to select the heating mode. In general, a user is likely to use a heating mode more often than a settings mode, so this saves time.

In another example, if the length of time that the button has been pressed is greater than or equal to a fourth threshold time period, but less than first time period, the device is configured to display a power level of the power source 118. This battery mode may be a settings mode, for example. The fourth threshold time period may be 1 second, for example. If the user holds down the button for longer than 1 second and less than 3 seconds, the device can display the power level. The power level may be indicated by the indicator assembly 306. For example, if the power level is between 0% and 25%, one of the four LEDs may be illuminated. If the power level is between 25% and 50%, two of the LEDs may be illuminated. If the power level is between 50% and 75%, three of the LEDs may be illuminated. If the power level is between 75% and 100%, four of the LEDs may be illuminated. The illumination can be solid or vary over time. For example one of the four LEDs may be illuminated and flashing to indicate that the power level than less than 10%.

The above describes just one specific type of input interface 112. In another example the user selects the operating mode using a touchscreen. In another example, there may be one or more input interfaces. For example, to operate the device in a first heating mode the user may operate a first input interface and to operate the device in a second heating mode the user may operate a second input interface.

Begin Heating after Operating Mode Selected

In a first example, the device is operated (in either a heating mode, or settings mode) only after the controller 302 has determined that an operating mode has been selected. Accordingly, the controller 302 may detect initial operation of the input interface as the user begins to hold down the button, for example, but does not cause the heater assembly to begin heating the aerosol generating material until the controller 302 determines that a heating mode has been selected. This can save energy because the user may be operating the input interface 112 to select a settings mode, rather than a heating mode.

Accordingly, if the controller 302 determines that a heating mode is selected based on the operation of the input interface 112, the controller 302 causes the heater assembly 304 to begin heating the aerosol generating material. The heater assembly 304 may be operated based on the particular type of heating mode selected. The selected operating mode can be determined based on the length of time the button is pressed, for example.

If the controller 302 determines that a settings mode is selected, the controller 302 can operate the device in the settings mode without causing the heater assembly 304 to begin heating the aerosol generating material. The device therefore only begins heating when the selected operating mode is a heating mode.

Begin Heating Before Operating Mode Selected

In a second example, the controller 302 causes the heater assembly 304 to begin heating before the controller 302 has determined whether the selected operating mode is heating mode or a settings mode. This can be useful to decrease the time between initially operating the input interface 112 and using the device. For example, it may be assumed that a user is more likely to operate the input interface 112 to operate the device in a heating mode rather than a settings mode so heating begins as soon as the controller 302 detects operation of the input interface 112, even if the controller 302 later determines that the selected operating mode is a settings mode rather than a heating mode.

Accordingly, in this second example, controller 302 is configured to detect selection of an operating mode based on the operation of the input interface 112, and cause the heater assembly 304 to begin heating the aerosol generating material before detecting selection of the operating mode.

If the controller 302 subsequently detects selection of a heating mode, the controller may cause the heater assembly 304 to begin heating the aerosol generating material according to the selected heating mode. This may involve continuing to heat the aerosol generating material at the same rate as before. In another example, this may involve changing the current heating rate to a second, different rate. Accordingly, before the controller 302 determines selection of a heating mode, the controller 302 may cause the heater assembly 304 to begin heating the aerosol generating material according to a first rate, and after detecting selection of the heating mode, the controller 302 may cause the heater assembly 304 to begin heating the aerosol generating material according to a second rate, different to the first rate. The first rate may be slower than the second rate to reduce the amount of energy that is wasted because there is a possibility the user may still select a settings mode.

If the controller 302 detects selection of a settings mode, the controller 302 causes the heater assembly 304 to stop heating the aerosol generating material.

In one example, the controller 302 causes the heater assembly 304 to heat at a first rate while the button has been pressed for an initial period of time without being released, and causes the heater assembly 304 to heat at a second rate while the button continues to be pressed after the initial period of time, where the first rate is slower than the second rate. At this point, the controller 302 will have not yet determined which operating mode is selected. The initial period of time may be 1, 2, or 3 seconds after the button has been pressed down, for example. In some examples, if the button is released before the initial period of time, the controller 302 may cause the heater assembly 304 to stop heating. This can guard against accidental button presses by acting as a buffer to save power. Short button presses may be indicative of accidental button presses.

Also, as mentioned above, the user may wish to check the battery status of the device by holding down the button for greater than 1 second and less than 3 seconds. Accordingly, if the button is pressed for a length of time less than 3 seconds, the heater assembly 304 may heat at the first, slower rate. If the button is pressed for a length of time greater than 3 seconds, the heater assembly 304 may heat at the second, faster rate. Thus, during the initial period of time (i.e. less than 3 seconds), the user may still be trying to select a settings mode to check the charge status of the battery, for example. By heating at a slower rate before this initial period of time, energy can be saved because there is a possibility that the user may select the settings mode to check the battery status.

Figure 8:
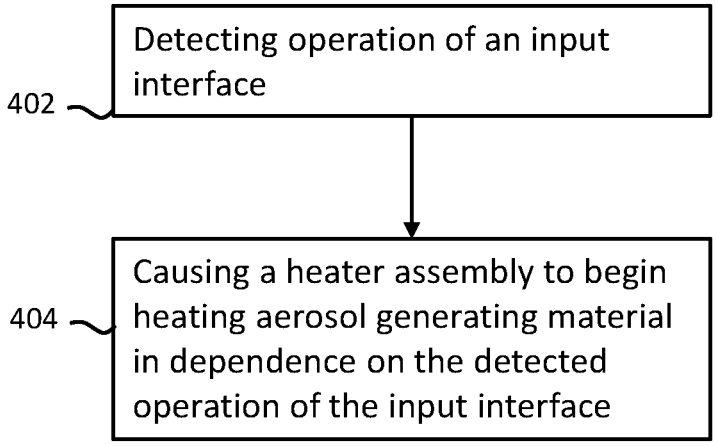
FIG. 8 shows a flow diagram of a method of operating a device.

FIG. 8 is a flow diagram of a method of operating an aerosol provision device. The method comprises, at block 402, detecting operation of an input interface, wherein the input interface is configured to receive an input for selecting an operating mode from a plurality of operating modes. The method comprises, at block 404, causing a heater assembly to begin heating aerosol generating material in dependence on the detected operation of the input interface.

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device, comprising:

a heater assembly configured to heat aerosol generating material;

an input interface configured to receive an input for selecting an operating mode from a plurality of operating modes, the plurality of operating modes comprising a plurality of heating modes, the plurality of heating modes comprising a first heating mode and a second heating mode, wherein when the device is operated in the first heating mode, a component of the heater assembly is to be heated to a first temperature, and when the device is operated in the second heating mode, the component of the heater assembly is to be heated to a second temperature; and a controller, configured to:

before the heater assembly has begun heating aerosol generating material according to a heating mode of the plurality of heating modes, detect operation of the input interface corresponding to an input;

determine a selected operating mode from the plurality of heating modes, based on the detected operation of the input interface corresponding to the input; and cause the heater assembly to:

(i) begin heating the aerosol generating material according to the first heating mode if the detected operation of the input interface corresponding to the input is indicative of a selection of the first heating mode; or (ii) (ii) begin heating the aerosol generating material according to the second heating mode if the detected operation of the input interface corresponding to the input is indicative of a selection of the second heating mode.

2. The aerosol provision device according to claim 1, wherein the controller is configured to:

determine a selected operating mode based on the operation of the input interface; and responsive to determining the selected operating mode, cause the heater assembly to begin heating the aerosol generating material according to the selected operating mode.

3. The aerosol provision device according to claim 2, wherein the input interface comprises a single button for receiving an input to select an operating mode from the plurality of operating modes.

4. An aerosol provision device comprising:

a heater assembly configured to heat aerosol generating material;

an input interface configured to receive an input for selecting an operating mode from a plurality of operating modes; and a controller configured to:

detect operation of the input interface; and cause the heater assembly to begin heating the aerosol generating material in dependence on the detected operation of the input interface, wherein the plurality of operating modes comprises a heating mode and a settings mode, and wherein:

when it is determined that the operation of the input interface is indicative of a selection of the heating mode, the controller is configured to:

determine a selected heating mode based on the operation; and cause the heater assembly to begin heating the aerosol generating material according to the selected heating mode;

when it is determined that the operation of the input interface is indicative of a selection of the settings mode, the controller is configured to:

operate the device in the settings mode without causing the heater assembly to begin heating the aerosol generating material.

5. An aerosol provision device comprising:

a heater assembly configured to heat aerosol generating material;

an input interface configured to receive an input for selecting an operating mode from a plurality of operating modes, wherein the input interface comprises a single button for receiving an input to select an operating mode from the plurality of operating modes; and a controller configured to:

detect operation of the input interface; and cause the heater assembly to begin heating the aerosol generating material in dependence on the detected operation of the input interface, wherein the input comprises an indication that the button has been released and an indication of a length of time the button was pressed before it was released, and wherein the controller is configured to, responsive to the input comprising the indication that the button has been released, determine a selected operating mode based on the length of the time the button was pressed before it was released.

6. The aerosol provision device according to claim 5, wherein a heating mode is determined as the selected operating mode when the length of time the button has been pressed is within a first time range and a settings mode is determined when the length of time the button has been pressed is a within a second time range, wherein the second time range has a start time after an end time of the first time range.

7. The aerosol provision device according to claim 5, wherein the device comprises an indicator assembly and the controller is configured to cause the indicator assembly to provide an indication based on the length of time the button was pressed.

8. An aerosol provision device comprising:

a heater assembly configured to heat aerosol generating material;

an input interface configured to receive an input for selecting an operating mode from a plurality of operating modes; and a controller configured to:

detect operation of the input interface; and cause the heater assembly to begin heating the aerosol generating material in dependence on the detected operation of the input interface, wherein the plurality of operating modes comprises a heating mode and a settings mode, and wherein the controller is configured to:

detect selection of an operating mode based on the operation of the input interface; and cause the heater assembly to begin heating the aerosol generating material before detecting selection of the operating mode.

9. The aerosol provision device according to claim 8, wherein the selected operating mode is a settings mode, and wherein the controller is configured to:

cause the heater assembly to stop heating the aerosol generating material after detecting that the selected operating mode is the settings mode.

10. The aerosol provision device according to claim 8, wherein the controller is configured to:

cause the heater assembly to begin heating the aerosol generating material:

before detecting selection of the operating mode; and after a predetermined period of time has elapsed since detecting an initial operation of the input interface.

11. The aerosol provision device according to claim 8, wherein the input interface comprises a single button for receiving an input to select an operating mode from the plurality of operating modes.

12. The aerosol provision device according to claim 11, wherein the input comprises an indication that the button has been released and an indication of a length of time the button was pressed before it was released, and wherein the controller is configured to:

responsive to the input comprising the indication that the button has been released:

determine a selected operating mode based on the length of the time the button was pressed before it was released.

13. The aerosol provision device according to claim 11, wherein the controller is configured to:

cause the heater assembly to heat at a first rate while the button has been pressed for an initial period of time without being released, and to cause the heater assembly to heat at a second rate while the button continues to be pressed after the initial period of time, wherein the first rate is slower than the second rate.

14. A method of operating an aerosol provision device, comprising:

detecting operation of an input interface, wherein the input interface is configured to receive an input for selecting an operating mode from a plurality of operating modes, wherein the plurality of operating modes comprises a heating mode and a settings mode; and causing a heater assembly to begin heating aerosol generating material in dependence on the detected operation of the input interface, and the method further comprises:

when it is determined that the operation of the input interface is indicative of a selection of the heating mode, causing the heater assembly to begin heating the aerosol generating material according to the selected heating mode; and when it is determined that the operation of the input interface is indicative of a selection of the settings mode, operating the device in the settings mode without causing the heater assembly to begin heating the aerosol generating material.

15. A method of operating an aerosol provision device, comprising:

detecting operation of an input interface, wherein the input interface is configured to receive an input for selecting an operating mode from a plurality of operating modes, wherein the input interface comprises a single button for receiving an input to select an operating mode from the plurality of operating modes;

detecting that the button has been released;

detecting a length of time the button was pressed before it was released;

determining a selected operating mode based on the length of the time the button was pressed before it was released; and responsive to detecting the selection of the operating mode, causing the heater assembly to begin heating the aerosol generating material according to the selected operating mode.

16. A method of operating an aerosol provision device, comprising:

detecting operation of an input interface, wherein the input interface is configured to receive an input for selecting an operating mode from a plurality of operating modes, the plurality of operating modes comprising a plurality of heating modes, the plurality of heating modes comprising a first heating mode and a second heating mode, wherein when the device is operated in the first heating mode a component of a heater assembly is to be heated to a first temperature, and when the device is operated in the second heating mode a component of the heater assembly is to be heated to a second temperature, and wherein the detecting operation of an input interface is before the heater assembly has begun heating aerosol generating material according to a heating mode of the plurality of heating modes;

determining a selected operating mode from the plurality of heating modes, based on the detected operation of the input interface corresponding to the input; and causing the heater assembly to:

(i) begin heating aerosol generating material according to the first heating mode if the detected operation of the input interface corresponding to the input is indicative of a selection of the first heating mode; or (ii) begin heating the aerosol generating material according to the second heating mode if the detected operation of the input interface corresponding to the input is indicative of a selection of the second heating mode.

17. The method of claim 16, further comprising:

detecting selection of an operating mode based on the operation of the input interface; and responsive to detecting the selection of the operating mode, causing the heater assembly to begin heating the aerosol generating material according to the selected operating mode.

18. A method of claim 16 operating an aerosol provision device, comprising:

detecting operation of an input interface, wherein the input interface is configured to receive an input for selecting an operating mode from a plurality of operating modes, wherein the plurality of operating modes comprises a heating mode and a settings mode;

detecting selection of an operating mode based on the operation of the input interface; and causing a heater assembly to begin heating the aerosol generating material before detecting selection of the operating mode.

19. The method of claim 18, wherein the input interface comprises a single button for receiving an input to select an operating mode from the plurality of operating modes, the method further comprising:

detecting that the button has been released;

detecting a length of time the button was pressed before it was released; and determining a selected operating mode based on the length of the time the button was pressed before it was released.

20. The method of claim 18, further comprising:

causing the heater assembly to begin heating the aerosol generating material:

before detecting selection of the operating mode; and after a predetermined period of time has elapsed since detecting an initial operation of the input interface.

* * * * *